United States Patent [19]

Haranoya et al.

[11] Patent Number: 4,879,969

[45] Date of Patent: Nov. 14, 1989

[54] ELECTROSTATIC FLOCKING APPARATUS

[75] Inventors: Tomoji Haranoya; Toshio Motegi, both of Ashikaga; Masaaki Abe, Ohmiya, all of Japan

[73] Assignees: Toyo Flocking Co., Tochigi; Mesac Corporation, Tokyo, both of Japan

[21] Appl. No.: 74,986

[22] Filed: Jul. 17, 1987

[30] Foreign Application Priority Data

Jul. 28, 1986 [JP] Japan ..... 61-177465
Sep. 5, 1986 [JP] Japan ..... 61-208032

[51] Int. Cl.[4] ..... B05B 5/00

[52] U.S. Cl. ..... 118/638; 118/625; 118/602; 118/612; 427/185

[58] Field of Search ..... 118/638, 640, 622, 625, 118/629, 602, 612; a427/200, 206, 26, 185, 195; 198/465.1; 414/217, 222

[56] References Cited

U.S. PATENT DOCUMENTS

| | | | |
|---|---|---|---|
| 2,173,032 | 9/1939 | Wintermute | 118/629 X |
| 2,174,328 | 9/1939 | Meston et al. | 118/629 |
| 2,750,681 | 6/1956 | Berry | 118/DIG. 5 |
| 3,097,958 | 7/1963 | Morris | 427/185 X |
| 3,197,328 | 7/1965 | Jung et al. | 118/DIG. 5 |
| 3,560,239 | 2/1971 | Facer et al. | 427/46 |
| 3,798,048 | 4/1974 | Brody et al. | 118/640 X |
| 3,834,927 | 9/1974 | Putney | 118/DIG. 5 |
| 4,093,753 | 6/1978 | Geary et al. | 427/200 X |
| 4,214,972 | 7/1980 | Shintock | 118/729 X |
| 4,293,249 | 10/1981 | Whelan | 414/217 X |
| 4,332,835 | 6/1982 | Knudsen | 118/625 X |
| 4,687,542 | 8/1987 | Davis et al. | 414/217 X |

OTHER PUBLICATIONS

"Fibers", Extra Edition, vol. 34 (Ser. vol. No. 394), Principle and Practice of Electrostatic Flocking Piles, Adhesives and Appliances; Sep. 20, 1982.

*Primary Examiner*—Shrive Beck
*Assistant Examiner*—Alain Bashore
*Attorney, Agent, or Firm*—Wenderoth, Lind & Ponack

[57] ABSTRACT

An electrostatic flocking apparatus has a flocking chamber, an air flow producing device for supplying and discharging air into and out of the flocking chamber, a filter for allowing the air out of the flocking chamber, but preventing the fibers from being discharged out of the chamber, an air box at the bottom of the flocking chamber and having a perforated board or wire mesh, electrodes, power sources electrically connected to the electrodes, a support for supporting the workpiece and a conveyor for conveying the work into and out of the flocking chamber.

7 Claims, 4 Drawing Sheets

ELECTROSTATIC FLOCKING APPARATUS

BACKGROUND OF THE INVENTION

This invention relates to an electrostatic flocking apparatus which is adapted to flock fibers on one or more surfaces of a workpiece.

A variety of electrostatic flocking apparatus have been proposed and practically employed. One of the prior art electrostatic flocking apparatus generally comprises, in a flocking chamber, an electrode or electrodes to which a high DC voltage is applied by a high DC generator, a box for holding fibers in the form of fine particles to be flocked on a workpiece and a means disposed in opposition to the electrode or electrodes for maintaining the fibers in a grounded condition.

In order to electrostatically flock the fibers on the workpiece by use of the prior art electrostatic flocking apparatus referred to above, the workpiece has a wet adhesive applied on at least one surface thereof and is held by a holding means, and a high DC voltage is applied to the electrode or electrodes with a high DC voltage generator.

Upon the application of voltage to the electrode or electrodes, an electric field is produced between the workpiece and electrode or electrodes and the lines of electric force of the electric field are oriented or directed to the workpiece. The fibers held within the box are charged in the directions of the lines of electric force whereby the fibers are caused to fly towards the workpiece. Since the workpiece has the adhesive applied on at least one surface thereof, the charged fibers penetrate the adhesive on the workpiece to provide a flocked product. The flocked product is then subjected to a drying step to dry the wet adhesive to provide a final flocked product.

However, the above-mentioned electrostatic flocking apparatus presents some problems.

The first problem is that when the charged fibers mix with the non-charged fibers held in the box which is disposed within the filtering chamber, the charged fibers tend to attract some of the non-charged fibers surrounding the charged fibers which do not fly easily. Even if the mass or masses of fibers fly, the fibers will be flocked unevenly on the workpiece resulting in a reject having an unevenly flocked surface or surfaces.

The second problem is that when the fibers fly in a relatively loose condition in the flocking chamber, the fibers may be sparsely flocked on the workpiece.

The third problem is that since the electrostatic flocking is performed by the utilization of the electric field produced between the electrode or electrodes and workpiece as mentioned hereinabove, when the workpiece has a smooth surface or surfaces, the lines of electric forces produced by the electrode or electrodes are uniformly distributed over the workpiece surface or surfaces, but when the workpiece has concave and/or convex surface or surfaces and especially, a recess or recesses as in a so-called deeply drawn moulding having irregular surfaces, the lines of electric force will not be uniformly distributed over the workpiece surface or surfaces. Thus, it is thought that fine flocking cannot be conducted on such a workpiece. In order to finely flock fibers on such a workpiece, it was necessary to employ a special electrode or electrodes adapted to produce lines of electric force which conform with the surface configuration of the workpiece, for example.

In addition to the above-mentioned problems with respect to performance, the prior art electrostatic flocking apparatus has a problem associated with the conveyance of the workpiece.

That is, in order to flock fibers in a predetermined density, it is necessary to cause the workpiece to dwell in the electric field generated within the flocking chamber for a predetermined time period. Thus, in order to efficiently treat a number of workpieces in succession, it is necessary to convey the workpieces in succession into the flocking chamber to have fibers flocked thereon and to convey the treated or flocked workpieces out of the flocking chamber in succession after the completion of the flocking operation to thereby enhance the operation efficiency of the apparatus.

With the aim of enhancing the operation efficiency of the flocking apparatus for electrostatically flocking fibers on a number of workpieces in succession, the conveying mechanism of the prior art flocking apparatus comprises a conveying means in the form of a conveyer or the like which extends from a setting position at which the workpiece is set on a support platform extending through the flocking chamber to a discharge position at which the flocking workpiece is discharged out of the system.

The conveying means is so designed that the workpiece conveyed to the set position in the flocking chamber is caused to dwell in the flocking chamber for a predetermined time period to have fibers flocked thereon and then is conveyed out of the flocking chamber.

However, although the prior art conveying mechanism enhances the operation efficiency of the electrostatic flocking apparatus by conveying the workpieces in succession into and out of the flocking apparatus, since the setting position of the workpiece and the processed workpiece discharge position are separate positions with the flocking chamber interposed therebetween, the flocking apparatus occupies a relatively large space and thus requires the same for the installation thereof.

And, since the flocking chamber is provided with openings in the opposite side walls thereof, a relatively large portion of the fibers filling the flocking chamber tend to disperse out of the chamber through the openings into the environment surrounding the flocking chamber.

Furthermore, when the conveyer is provided within the flocking chamber, it is very difficult to cleam the lower run of the conveyer psoitioned below the workpiece and/or workpiece support platform. Thus, there is the possibility that replacement of the fibers with different fibers is troublesome and/or a portion of the fibers employed in the previous step tend to adhere to a portion of the flocking chamber and mix with the latter fibers to be employed in the succeeding step resulting in the production of a reject.

SUMMARY OF THE INVENTION

Therefore, one object of the present invention is to provide an electrostatic flocking apparatus in which a mass or masses of fibers are readily polarized in the flocking chamber, wherein the massis are finely divided into discrete fibers and moisturized to adjust the characteristic ability of the fibers to be deposited on the workpiece and thus prevent the fibers from adhering to the workpiece in mass form and wherein an atmosphere is formed in the flocking chamber and the fibers are caused to enter an electric field produced between adjacent electrodes in the atmosphere so that the fibers can fly in a highly dense arrangement in all directions towards the workpiece whereby the fibers can be uniformly flocked on the workpiece.

Another object of the present invention is to provide an electrostatic flocking apparatus wherein even when the workpiece is a so-called deeply drawn moulding having an extremely concave and/or convex surface or surfaces, the fibers can be uniformly flocked on the entire surface area of the workpiece including the convex, concave surfaces and recess or recesses of the workpiece without the use of an electrode or electrodes exclusively designed for flocking the drawn moulding.

A further object of the present invention is to provide the above-mentioned electrostatic flocking apparatus with a conveying mechanism adapted to convey the workpiece into and out of the flocking chamber in the electrostatic flocking apparatus that requires a minimum amount of space.

A further object of the present invention is to provide an electrostatic flocking apparatus which minimizes the dispersion of fibers into the environment surrounding the flocking chamber.

A still further object of the present invention is to provide an electrostatic flocking apparatus wherein the interior of the flocking chamber can be easily cleaned and the replacement of fibers can be easily performed.

In order to attain the above-mentioned objects, one embodiment of the electrostatic flocking apparatus according to the present invention generally comprises:

a flocking chamber in which fibers to be electrostatically flocked on a workpiece fly;

an air blow producing means for producing an air stream which divides a mass or masses of the fibers into discrete fibers for easy polarization thereof at the bottom of the flocking chamber, blows up the discrete fibers into the flocking chamber and then exhausts out of the flocking chamber at the ceiling of the flocking chamber;

a filter means provided in said upper portion of the flocking chamber for allowing said air flow to exhaust out of said flocking chamber while preventing said fibers from flowing out of the flocking chamber;

a vibratory air box formed at the bottom of the flocking chamber and having a perforated board or mesh screen through which air passes and on which the fibers are deposited, the air box being supplied with air and rocked or vibrated;

a drive means for rocking or vibrating said air box;

an electrode means disposed within the flocking chamber above the vibratory air box and comprising uppermost, intermediate and lowermost electrodes in a vertically spaced relationship to solve the above-mentioned problem;

three power source means electrically connected to said first, second and third electrodes, respectively;

a support means for supporting said workpiece between said first and second electrodes;

a conveying means for conveying said workpiece into the flocking chamber and for conveying the workpiece, after said fibers have been flocked thereon, out of the flocking chamber; and means for preventing said fibers flying in said flocking chamber from dispersing out of the flocking chamber.

The electrostatic flocking apparatus is preferably provided with a means for recycling the air discharged from said flocking chamber along a recycling path and back into the flocking chamber. A moisturizing adjustment means and a moisture adjustment means are preferably provided in the recycling path.

The drive means for driving the vibratory air box comprises a rotation drive source and a crank mechanism connecting the rotation drive source and air box, for example.

The three electrodes do not necessarily have a complicated configuration and may each comprise a ladder-like structure which includes a framework electrically connected to the associated power source and a plurality of parallel and spaced-apart wires extending across the framework.

Each of the power means electrically connected to the first and second electrodes has a means for switching the polarity of the electrode connected thereto and a means for varying the value of high voltage to be applied to the electrode.

The flocking chamber is preferably provided with the opening, adapted to be opened and closed, in only one side wall thereof. Furthermore, an air curtain chamber is preferably provided in opposition to the opening for preventing the fibers from dispersing out of the flocking chamber when the opening is opened. The air curtain chamber is preferably provided as a bypass in the above-mentioned recycle path to act as a blower for sucking in external air and a fiber recovery box is preferably provided in the recycle path.

A lifter is provided in opposition to the opening in the flocking chamber as a means for conveying a workpiece into and out of the flocking chamber and the lifter includes vertically movable holding means disposed on different levels. Each holding means is adapted to hold a workpiece conveying means to which the workpiece is secured by means of a suitable jig or jigs and bring the conveying means to a position in alignment with horizontal rails in the flocking chamber for transferring the conveying means onto the rails via the opening after the holding means moves upwardly. After the workpiece has fibers flocked thereon, the conveying means having the treated workpiece supported thereon is transferred from the rails onto the holding means which is now in alignment with the rails whereby the treated workpiece is ready to be released from the conveying means so as to be subjected to a further processing step or steps.

The above and other objects and attendant advantages of the present invention will be more readily apparent to those skilled in the art from a reading of the following detailed description in conjunction with the accompanying drawings which show one embodiment of the invention for illustrative purposes only, but not for limiting the scope of the same in any way.

DETAILED DESCRIPTION OF THE PREFERRED EMBODIMENT

Figure 1:
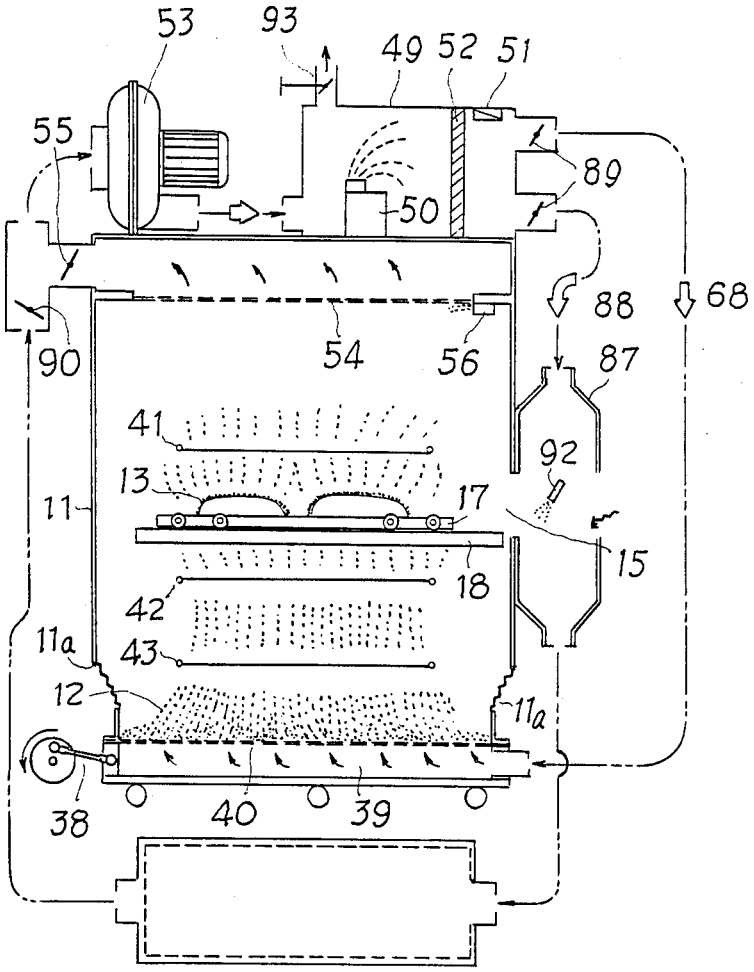
FIG. 1 is a vertically sectional schematic view of one embodiment of the electrostatic flocking apparatus according the the present invention.

The present invention will be now discribed referring to the accompanying drawings which show the preferred embodiment of the present invention for illustrative purposes only, and not for limiting the scope of the same in any way.

FIGS. 1 to 4 inclusive show the preferred embodiment of the electrostatic flocking apparatus according to the present invention. Reference numeral 11 denotes a flocking chamber wherein fibers are to be flocked on a workpiece and which includes a vibratory air box 39 formed at the bottom of the chamber and having a perforated top board or wire mesh 40 which is preferably formed of conductive material and which forms the inner bottom surface of the flocking chamber on which the fibers 12 are deposited.

A shock absorber 11*a* formed of resilient material connects the lower end of the flocking chamber 11 and the upper end of the air box 39 to absorb the vibratory movement of the vibratory air box.

Suitably disposed above the perforated top board 40 within the flocking chamber 11 are uppermost, intermediate and lowermost electrodes 41, 42 and 43, which are vertically spaced and extend horizontally. Grounded rails 18 are interposed between the uppermost and intermediate electrodes 41, 42 and extend parallel and in a spaced relationship to each other and the electrodes. A filter 54 is stretched across an upper portion of the interior of the flocking chamber 11 and an air blower 53 is disposed on the top of the chamber. An opening 15 is formed in only one side wall of the flocking chamber 11 and has a shutter 14. A work-piece 13 is conveyed by a suitable means which will be described hereinafter into and out of the flocking chamber 11 through the opening 15. An air flow means is provided in cooperation with the opening 15. The air flow means is adapted to recycle the exhaust air from the top of the flocking chamber 11 to the air box 39. Provided adjacent to the opening 15 are an air curtain mechanism 87 which utilizes the air from the air flow means and an air jet mechanism 92. The perforated board or wire mesh 40 is formed of conductive material and is grounded.

A truck 17 formed of conductive material and having the workpiece 13 secured thereto by means of a conductive jig or jigs is guided along the rails 18. Thus, the workpiece 13 is grounded. The workpiece 13 has an adhesive applied on at least one surface thereof. With the workpiece 13 grounded, the electrostatic flocking apparatus is in an operative condition. When the electrostatic flocking apparatus operates, the air box 39 at the bottom of the flocking chamber 11 is vibrated or rocked by a crank mechanism 38 and simultaneously, air is blown into the air box 39. The air blown into the air box 39 is forced to pass upwardly through the apertures in the perforated board or wire mesh 40 which forms the inner bottom surface of the flocking chamber 11 and on which the fibers 12 are introduced into the flocking chamber 11. The vibratory or rocking motion of the air box 39 and the flow of air passing through the perforated board 40 dislodge the fibers 12 from the board and blow the fibers upwardly within the flocking chamber 11 uniformly dispersing the same. The uniformly dispersed fibers 12 can be easily polarized by the lowermost electrode.

A high DC voltage (positive, for example) is applied to the lowermost electrode 43 by a high voltage generator 44 via air insulator (not shown).

A high DC voltage (negative, for example) is applied to the intermediate electrode 42 by a high DC voltage generator 48 via an insulator (not shown).

Furthermore, a high DC voltage (positive, for example) is applied to the uppermost electrode 41 by DC voltage generators 45, 46, 47 via an insulator (not shown).

Thus, the fibers 12 caused to fly upwardly within the flocking chamber 11 are polarized under the action of the electric field produced by the lowermost electrode 43 and are attracted to the electrode 43. Furthermore, the fibers 12 are charged by the lowermost electrode 43 and then enter the electric field produced by the intermediate electrode 42 whereupon the fibers are attracted to the intermediate electrode and fly upwardly within the flocking chamber 11. That is, the fibers 12 fly in the flocking chamber 11 in a highly dense arrangement due to the above-mentioned phenomenon.

The condition under which the fibers 12 flying within the flocking chamber 11 enter the electric field produced between teh intermediate and lowermost electrodes 42, 43 will now be described. When the fibers 12 flying in the above-mentioned condition pass by the intermediate electrode 42, the fibers are charged by the intermediate electrode and fly towards the uppermost electrode 41 by the lines of electric force of the electric field produced between the intermediate and lowermost electrodes 42, 43. The workpiece 13 is disposed in a grounded condition between the intermediate and uppermost electrodes. If the undersurface of the work 13 has an adhesive applied thereon, the fibers 12 penetrate the adhesive due to the electric field produced between the intermediate electrode 42 and workpiece 13. Thus, the fibers are flocked on the undersurface of the workpiece 13. Fibers which have not penetrated the adhesive are attracted towards the uppermost electrode 41 to be charged by th electrode. The charged fibers 12 are dispersed under the influence of the repulsive force generated by the electrode 41. As the fibers 12 pass by the uppermost electrode 41, the fibers are charged by the electrode 41. And the fibers fly in a highly dense arrangement between the uppermost electrode 41 and the ceiling of the flocking chamber 11.

The behavior of the fibers flying in a dispersed state will now be described briefly. When the fibers 12 are disposed adjacent to the lowermost electrode 43, since the fibers are charged with the same polarity as that of the uppermost electrode 41, the fibers tend to move away from the electrode 41 by the repulsive force acting between the fibers 12 and electrode 41.

When the fibers fly towards the intermediate electrode 42, the fibers fly while being attracted towards the intermediate electrode 42. Since the workpiece 13 is in a grounded condition and is disposed between the intermediate and uppermost electrodes 42, 41, the fibers 12 that fly while being attracted towards the electrode 42 strike against the upper surface of the workpiece 13. Thus, if the upper surface of the workpiece 13 has an adhesive applied thereon, the fibers will penetrate the adhesive to thereby flock on the upper surface. Fibers which have not struck the workpiece, are attracted towards the intermediate electrode 42 whereby the fibers are charged with the same polarity as that of the intermediate electrode 42. Thus, the fibers 12 can fly towards the uppermost and lowermost electrodes 41, 43. The fibers flying towards the uppermost electrode 41 are attracted by the electrode and the fibers flying towards the lowermost electrode 43 are attracted towards the electrode. Some of the fibers which have passed by the lowermost electrode 41 drop onto the bottom surface of the flocking chamber 11. The fibers which have dropped onto the bottom surface of the flocking chamber 11 are repeatedly blown upwardly and fly as described above. Thus, the flocking of the fibers on the workpiece is performed while the fibers are flying in a highly dense arrangement.

Next, the flying condition of the fibers when the intermediate and uppermost electrodes have the same polarity will be described.

As described hereinabove, the fibers 12 deposited on the bottom of the flocking chamber 11 are caused to fly upwardly by the blowing-up action of air and the electric field produced between the uppermost and lowermost electrodes 41, 43. When the fibers 12 enter the electric field produced between the intermediate and uppermost electrodes 42, 41 since the two electrodes have the same polarity, a repulsive force acts between the electrodes to cause the fibers to fly in the direction of the lines of electric force of the electric field. Thus, if the side faces of the workpiece 13 have adhesive applied thereon, the side faces of the work are flocked. And, the fibers strike against the electrodes, pass by the electrodes or fly in the vicinity of the electrodes and the fibers always fly in various directions under the electric field generated by the electrodes in a highly dense arrangement within the flocking chamber as described hereinabove.

In the flocking apparatus described hereinabove and illustrated in the drawings, by imparting the same polarity or opposite polarities to adjacent electrodes and/or by varying the voltage to be applied to the electrodes, the direction of the electric field to be established between adjacent electrodes, of the electric field to be established between a particular electrode and the workpiece, and of lines of electric force of the electric fields can be varied. Thus, an electric field that is optimum for flocking fibers to the surface of the workpiece can be established even when the workpiece has an irregular configuration such as a deeply drawn moulding or a ring. And, if the electrodes and workpiece can be moved by known means, the above-mentioned effect can be more pronounced.

While the fibers 12 are being flocked on the workpiece 13 within the flocking chamber 11, the fibers fly in a highly dense arrangement due to the blown air and the electric field established.

The air is normally discharged from the flocking chamber 11 by the air blower 53.

Thus, the fibers 12 flying the flocking chamber in the manner described hereinabove are concentrated at the exhaust port together with the blown-in air. However, since the filter 54 is adapted to exhaust only the air and prevent the flying fibers from passing therethrough and is stretched across the upper portion of the flocking chamber 11, the fibers are arrested by the filter. Thus, the fibers are prevented from being carried away to the exterior of the flocking chamber 11 by the exhausting air.

Furthermore, in order to prevent the clogging of the filter 54 with the fibers, an air nozzle 56 is provided adjacent to the filter 54. The fibers 12 arrested by the filter 54 are blown off the filter by air sprayed from the nozzle 56 to thereby prevent the clogging of the filter 54 with the fibers.

Since the fibers 12 have passed through the electric field while flying within the flocking chamber 11, the fibers have been electrically charged. When the charged fibers drop onto the non-charged fibers deposited on the perforated board or wire mesh 40, the charged fibers tend to electrically attract the non-charged fibers to form masses of fibers. However, as mentioned hereinabove, the vibratory movement of the perforated board 40 caused by the vibration of the air box 39 and the air forced through the apertures in the perforated board 40 break the masses into discrete fibers.

The electrodes 41, 42, 43 have a simple configuration, that is, the electrodes 41, 42, 43 comprise respective frameworks **41*a*, 42*a*, 43*a* and a plurality of wires 41*b*, 42*b*, 43*b*** extending parallel and in a spaced relationship across the frameworks, respectively.

With the above-mentioned structure and arrangement of the components of the flocking apparatus according to the present invention, when the electrodes 41, 42, 43 are energized by current supplied by their respectively associated power sources or high voltage generators and a high voltage is applied to their respective wires **41*b*, 42*b*, 43*b* via the respective frame members 41*a*, 42*a*, 43*a***, a strong discharge occurs between the adjacent electrodes through the wires to provide lines of high electric force.

Figure 2:
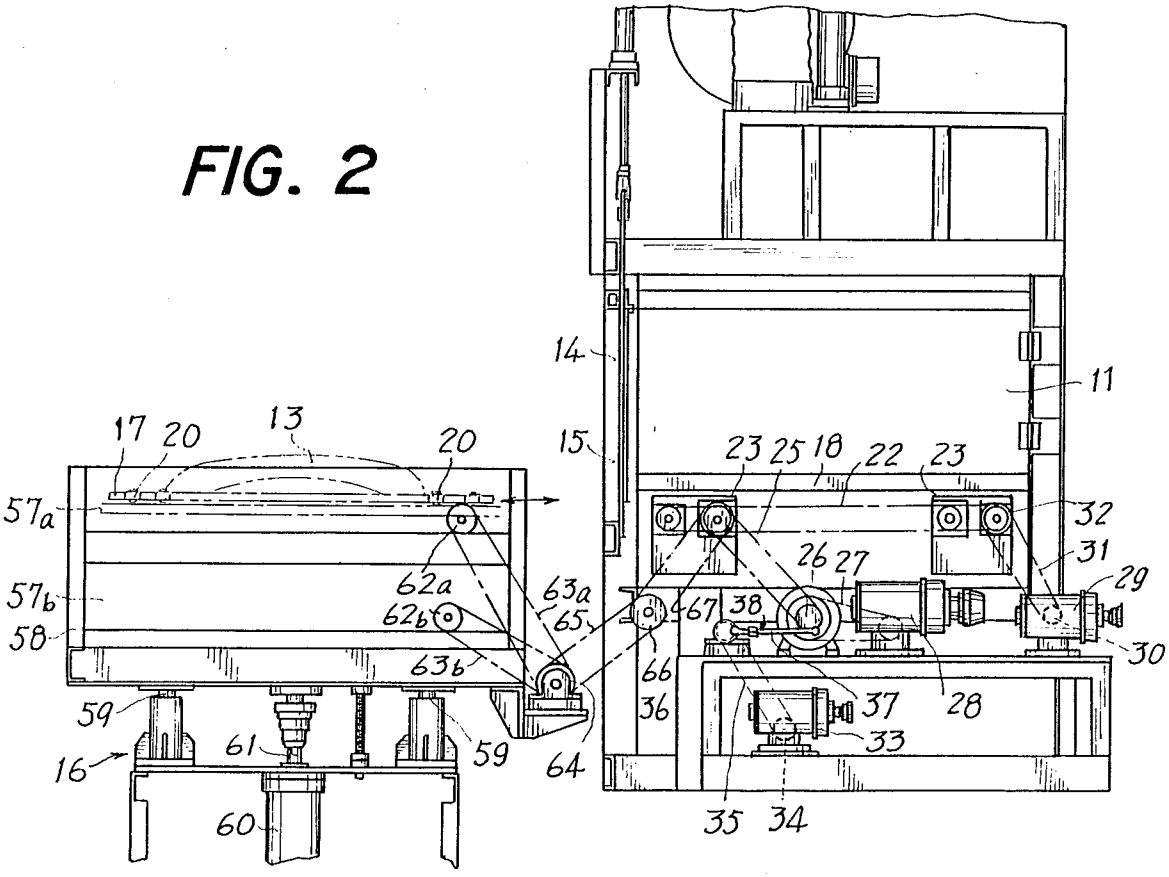
FIG. 2 is a side elevational view of the flocking apparatus shown in FIG. 1 with a portion thereof cut away.
Figure 4A:
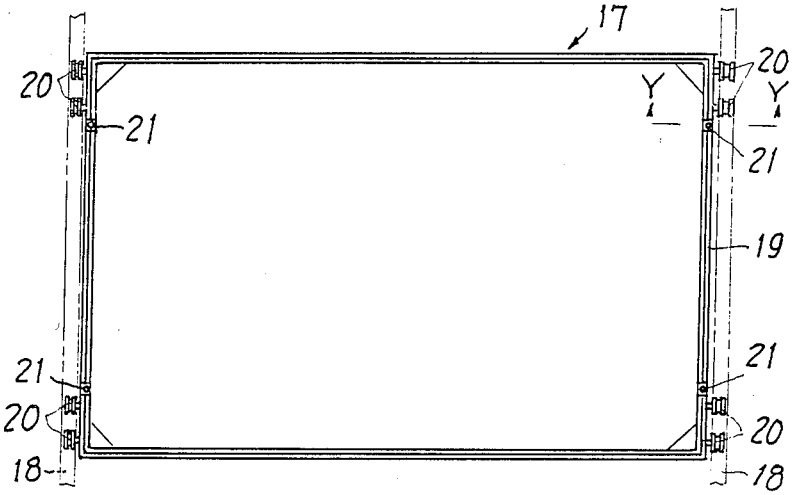
FIG. 4A is a plan view on an enlarged scale of the truck employed in the flocking apparatus shown in FIG. 1.
Figure 4B:
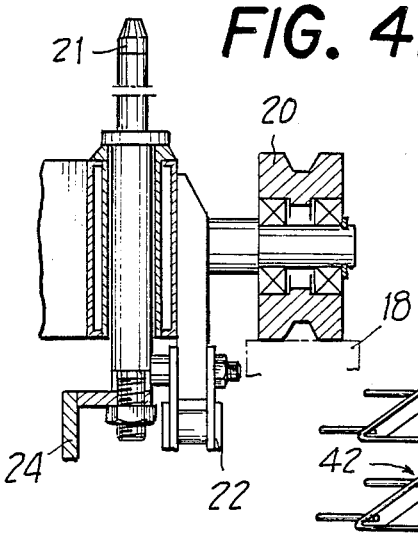
FIG. 4B is a fragmentary vertically sectional view on an enlarged scale taken along the line Y—Y in FIG. 4A.
Figure 3:
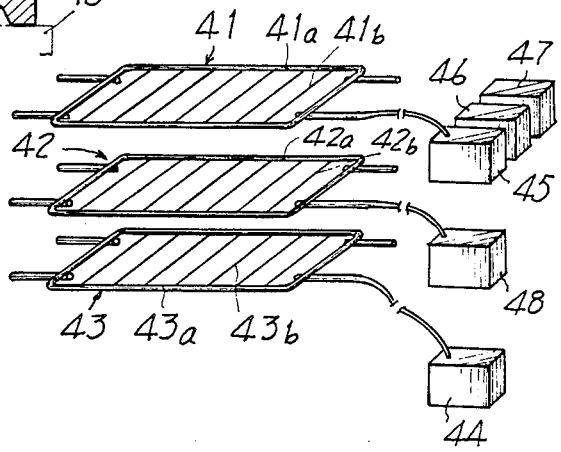
FIG. 3 is a perspective view on an enlarged scale of an electrode means in the flocking apparatus shown in FIG. 2.

Now turning the FIG. 2, a lifter 16 is provided in opposition to the opening 15 and the workpiece 13 is held on the truck 17 by means of a suitable jig or jigs (not shown). The truck 17 is adapted to move from a position on the lifter 16 into the flocking chamber 11 and from the flocking chamber to the position on the lifter through the opening 15 in the flocking chamber 11. Two horizontal rails 18 extend parallel and in a spaced relationship within the flocking chamber 11 and the truck 17 is guided along the rails. The guide rails 18 are grounded and thus, the workpiece 13 on the truck 17 is also grounded. As is more clearly shown in FIGS. 4A, 4B, the truck 17 comprises a rectangular frame member 19, rollers 20 rotatably mounted at the opposite ends of the frame member 19 and adapted to roll on the guide rails 18, projections 21 extending upwardly from the frame member 19 adjacent to the rollers 20 for securing the workpiece 13 to the truck and an endless chain 22 extending along one end of the frame member 19 and trained about sprockets 23 to be rotated thereby as the sprockets 23 rotate whereby the truck 17 is guided along the rails 18 to be moved into and out of the flocking chamber 11. The truck 17 is also provided with a bar 24 for transmitting a vibratory driving force from a vibrator which will be described hereinafter.

The sprockets 23 are rotated by a reversible motor 28 through a chain 25, a sprocket 26 and a chain 27 which are provided outside of the flocking chamber 11. Reference numeral 29 denotes a vibration motor which reversibly rotates a sprocket 32 through a chain 31 and a vibratory force from the vibration motor 29 is transmitted through the shaft of the sprocket 32 to the interior of the flocking chamber 11 wherein a suitable table means (not shown) is adapted to engage the above-mentioned bar 24 so as to vibrate the truck 17.

Also provided outside of the flocking chamber 11 is a motor 33 as a drive means which vibrates the above-mentioned air box 39.

In the illustrated embodiment, an air flow producing means for supplying and exhausting air into and out of the flocking chamber 11 comprises a means adapted to recycle the air exhausted from the flocking chamber 11 along a recycle path 68 back into the flocking chamber 11. The blower 53 and a moisturizing box 49 are provided in the recycle path 68. The blower 53 sucks in the air from the flocking chamber 11 which has passed through the filter 54 and has been constricted through a damper 55 and pumps the air into the moisturizing box 49.

The air is moisturized by a moisturizer 50 in the moisturizing box 49 and fed into the air box 39 after the humidity of the air has been controlled to a value by a moisture eliminator 52 in accordance with a signal from a humidity sensor 51. The moisturization of the air is maintained within the flocking box 11 at an optimum value for electrostatic deposition in a standard atmosphere, but the resistance value of the fibers may vary depending upon the relatively humidity of the air. In this case, the fibers having the varied resistance value cannot be satisfactorily flocked. To overcome this problem, it may be obvious to moisturize the flocking chamber, but according to the present invention, the fibers deposited on the perforated board 40 are moisturized before the fibers fly upwardly within the flocking chamber 11 so that the fibers are maintained in a good condition. That is, when the interior of the flocking chamber 11 is dry, the fibers are weakly charged and do not fly well. Thus, the fibers would tend to penetrate the adhesive layer on the workpiece to a shallow depth and sparsely. However, according to the present invention, the fibers are strongly charged and fly well whereby the fibers penetrate the adhesive layer to an optimum depth and in an optimum density.

The lifter 16 is provided with workpiece holding means **57*a*, 57*b* disposed on two different levels and the holding means 57*a*, 57*b* are formed within the travelling framework 58 of the lifter 16. The travelling framework 58 is supported by guide rods 59, 59 for guiding the framework in vertical movement and is operatively connected to the rod 61 of a cylinder 60. Thus, as the cylinder 60 is operated, the travelling framework 58 moves upwardly and downwardly. The work holding means 57*a*, 57*b* can each support the truck 17 and are provided with sprockets 62*a*, 62*b*, respectively, for driving the above-mentioned chain 22 on the truck 17. A drive force is transmitted from a truck drive means on the flocking chamber 11 to the sprockets 62*a*, 62*b* via chains 63*a*, 63*b*, a sprocket 64, a chain 65, a sprocket 66 and a chain 67**.

Now, the operation of the embodiment will be described. During operation, a mass or masses of the fibers 12 deposited on the perforated board 40 of the vibratory air box 39 at the bottom of the flocking chamber 11 shown in FIG. 1 are divided into descrete fibers for easy polarization and are blown into the flocking chamber by the vibration of the perforated board 40 and the air passing upwardly through the apertures in the perforated board 40. With the fibers blown upwardly into the flocking chamber 11, when a high DC positive voltage, for example, is applied to the lowermost electrode 43 and a high DC negative voltage, for example, is applied to the intermediate electrode 42, the flying fibers 12 are polarized and further urged upwardly within the flocking chamber 11 under the influence of the electric field produced between the two electrodes 42, 43. On the other hand, the fibers 12 deposited on the perforated board 40 of the vibratory air box 39 are finely dispersed by the rocking or vibratory movement of the box and board by the crank mechanism 38 and the air flow passing through the apertures in the perforated board. And, the flying fibers charged in the electric field within the flocking chamber 11 drop onto the non-charged fibers 12 deposited on the perforated board 40 and mix with non-charged fibers to charge the latter resulting in the formation of masses of fibers due to electrical attraction therebetween. However, the masses are broken into fine discrete fibers by the rocking and vibratory movement of the vibratory air box 39 and the air flow passing through the apertures in the perforated board 40 and are then blown upwardly.

When two adjacent electrodes, that is the uppermost and intermediate electrodes 41, 42, are polarized with the same polarity, the direction of lines of force of the electric field produced between the two electrodes is different from the direction of lines of force of the electric field produced between the two adjacent electrodes polarized with opposite polarities. And, it is also possible to vary the direction of lines of force of the electric field produced between the two adjacent electrodes by varying the voltage applied to the two adjacent electrodes. Furthermore, when time factors are involved, a variety of electric fields can be produced. By the utilization of the above-described capability, fibers can be uniformly flocked on the irregular surfaces of three-dimensional articles such as deeply drawn mouldings.

Figure 5:
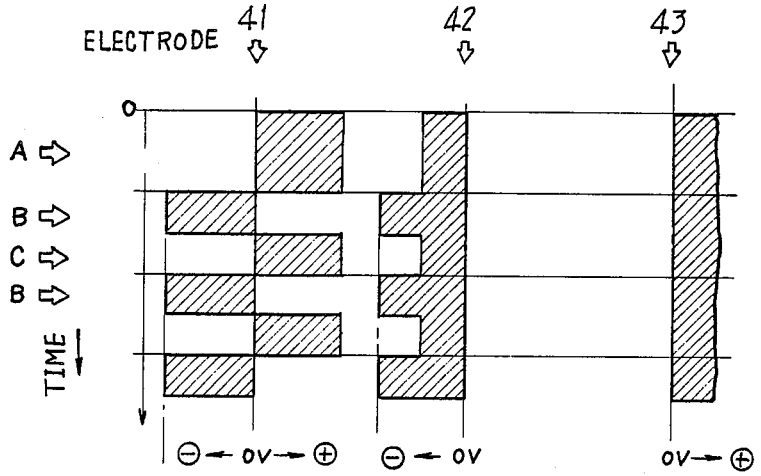
FIG. 5 is a time chart showing one mode of controlling the three electrodes of the electrode means shown in FIG. 3.
Figure 6A:
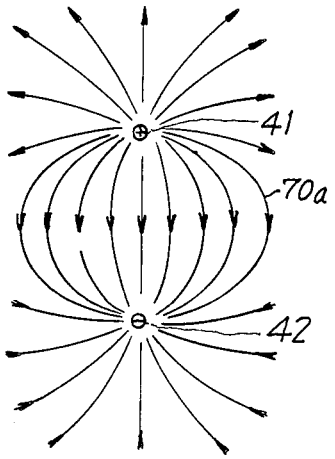
FIG. 6A shows one condition of lines of electric force in the electric field produced between the intermediate and uppermost electrodes in the electrode means shown in FIG. 3.
Figure 6B:
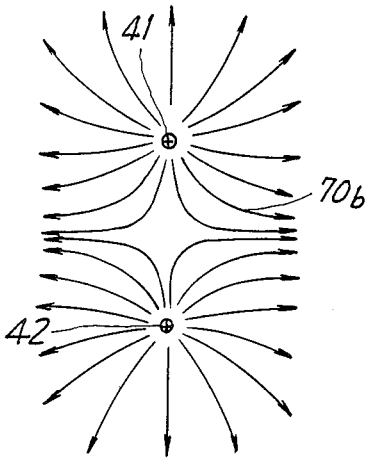
FIG. 6B shows another condition of lines of electric forces in the electric field produced between the intermediate and uppermost electrodes in the electrode means shown in FIG. 3.

Turning now to FIG. 5 which is a time chart showing one control mode of the electrodes, A shows the initial fiber filling condition in the flocking chamber 11 wherein the fibers 12 caused to fly upwardly by the air flow and dispersed so as to be easily polarized are further urged upwardly by the electric field produced between the lowermost electrode 43 to which positive voltage is applied and the intermediate electrode 42 to which negative voltage is applied and that produced between the uppermost electrode 41 to which positive voltage is applied and the intermediate electrode 42. And, especially due to the electric field between the lowermost and intermediate electrodes 43, 42, the fibers fly in a highly dense arrangement. In this Figure, B and C show instances in which the electrodes 41, 42 are imparted with the same polarity and opposite polarities, respectively and these modes are alternated a suitable number of times. When electrodes 41, 42 have opposite polarities, the lines of electric force produced are as shown by **70*a* in FIG. 6A and the fibers 12 are oriented and flow in the directions along these lines of electric force. Thus, the fibers 12 are predominantly flocked on one surface of the workpiece 13 disposed between the electrodes 41, 42. When the electrodes 41, 42 have the same polarity, a repulsive force acts between the two electrodes and the lines of the electric force will be as shown by 70*b* in FIG. 6B. Thus, the fibers 12 fly in the direction along the lines 70*b* of electric force and the fibers are predominantly flocked on the side and end faces (as well as the recess or recesses in the surface or surfaces) of the workpiece 13. By alternating the same polarity and opposite polarity modes of the electrodes a number of times, the fibers can be uniformly flocked on the entire surface area of the workpiece 13** even if the workpiece is a deeply drawn moulding having extremely concave and convex surfaces.

Next, the operation for conveying the workpiece 13 into and out of the flocking chamber 11 will be described referring to FIG. 2. First of all, the workpiece 13 is held on the truck 17 which is disposed on either one of the holding means 57*a*, 57*b*. The shutter 14 normally held in the closed position is then opened and the lifter 16 is raised to align the truck 17, on which the workpiece 13 is set, with the rails 18. Then, the truck 17 is moved through the opening 15 until the truck rides on the rails 18. The conveying operation is carried out by rotating the sprockets 62*a*, 62*b*, 23 and accordingly, the chain 22 on the truck 17 trained over these sprockets. When the truck 17 has been properly positioned on the rails 18, the shutter 14 is closed. Since the chain 22 is provided on the truck 17, only the rails 18 for guiding the truck 17 and the sprockets 23 are required as means for conveying the work within the flocking chamber 11. Thus, it is only necessary to provide a quite simple mechanism within the flocking chamber 11 and when the fibers are replaced with new ones, the fibers previously disposed within the flocking chamber can be easily and perfectly purged out of the flocking chamber.

The workpiece 13 disposed between the electrodes 41, 42 has the fibers flocked thereon by the electrostatic flocking apparatus as mentioned hereinabove, but during the electrostatic flocking, the truck 17 having the workpiece held thereon is set on the other holding means 57*a* or 57*b*. At the completion of the flocking of the first workpiece 13, the sprockets 23 are rotated in the direction opposite to that in which the sprockets were rotated when the truck was conveyed into the flocking chamber 11 and the shutter 14 is opened again and the truck 17 is moved back onto the holding means 57*b* or 57*a*.

Thereafter, the lifter 16 is further raised to position the holding means 57*a* or 57*b* on which the processed or flocked workpiece 13 is set to a level above the rails 18 and position the other holding means 57*a* or 57*b* so that the truck 17 on the other hold means is aligned with the rails 18. The truck 17 is then conveyed through the opening 15 onto the rails 18 for carrying out the flocking operation on the next workpiece 13 in the same manner as performed on the first workpiece 13.

Basically, by repeating the above-mentioned procedure, successive workpieces 13 have fibers electrostatically flocked thereon. The conveying of the workpieces 13 into and out of the flocking chamber 11 can be automatically and effectively carried out.

Since the lifter 16 which is adapted to deliver the workpiece 13 into the flocking chamber 11 and receive the workpiece from the flocking chamber is provided adjacent to only one side of the flocking chamber 11 and the holding means 57*a*, 57*b* are disposed at different levels, the space required for the conveying mechanism is less than that for the conveying mechanism in the prior art electrostatic flocking apparatus. And, since the conveying of the workpiece 13 into and out of the flocking chamber 11 is performed through the sole opening 15, the area of the opening 15 may be made small enough so that the possibility of the fibers escaping from the interior of the flocking chamber 11 can be minimized, accordingly.

In the illustrated embodiment, although the workpiece holding means are disposed at two different level, the holding means may be disposed at three or more different levels according to the present invention. And, the arrangement of the electrodes is also not limited to that shown in the illustrated embodiment. The polarity arrangement of the electromagnets may be also reversed from that described hereinabove. Even when the polarity arrangement is reversed, when the adjacent electrodes are polarized with the opposite polarities, an attraction force or a repulsive force may act between the adjacent electrodes.

As is clear from the foregoing description of the preferred embodiment, according to the electrostatic flocking apparatus of the invention, the fibers will not aggregate into a mass or masses and thus, although the fibers fly in tufts within the flocking chamber, the fibers will not be flocked on the workpiece in tufts, but will be flocked uniformly on the workpiece. Even when the workpiece has convex and concave surfaces, the fibers can be uniformly flocked on the workpiece by controlling the voltage to be applied to the electrodes.

And, since the opening is provided in only one side of the flocking chamber, the lifter including the work holding means disposed at least at two different levels is provided in opposition to the opening and the workpiece is transferred between the holding means and the flocking chamber, the space required for the workpiece conveying mechanism is relatively small and thus, the whole apparatus can be relatively compact.

The provision of the sole opening in the filtering chamber can minimize the amount of dispersion of the fibers into the environment surrounding the filtering chamber and the cleaning of the interior of the filtering chamber can be easily performed whereby the fibers can be easily replaced with new fibers. The provision of the sole opening in the filtering chamber makes it easy to control the moisture within the filtering chamber.

Furthermore, the mechanism for conveying the workpieces into and out of the filtering chamber comprises simple rails which require a minimum amount of space within the filtering chamber and cleaning of the interior of the filtering chamber can be simply and perfectly performed without being impeded by the rails.

While only one specific embodiment of the invention has been shown and described in detail, it will be understood that the same is for illustrative purposes only and not to be taken as limitative of the invention, the invention being defined only in the appended claims.

We claim:

1. An electrostatic flocking apparatus comprising:

a flocking chamber;

flock support means disposed at the bottom of said flocking chamber for supporting flock within said flocking chamber, said flock support means comprising a box, a perforated board or mesh screen defining an upper surface of the box for supporting flock, and vibratory or rocking means operatively connected to said box for vibrating or rocking said box to separate mass or masses of flock supported on the upper surface of said box into discrete fibers;

an air blow producing means for forcing a stream of air upwardly through said upper surface of said box that blows the discrete fibers supported on said upper surface upwardly in said flocking chamber;

filter means disposed at an upper portion of said flocking chamber for allowing the stream of air to discharge therethrough and for preventing the fibers blown by the stream of air to discharge therethrough;

a first electrode disposed between the upper surface of said box and said filter means;

a second electrode disposed between said first electrode and the upper surface of said box;

a third electrode disposed between said second electrode and the upper surface of said box for polarizing the discrete fibers as they are blown upwardly in said flocking chamber by the stream of air;

three power source means electrically connected to said first, second and third electrodes, respectively for impressing respective voltages on said electrodes, the power source means of at least one of said first and said second electrodes including a polarity changeover means for changing the polarity of the voltage of the electrode to which said power source means including the polarity changeover means is electrically connected; and workpiece support means within said flocking chamber for supporting a workpiece to be flocked between said first and said second electrodes.

2. An electrostatic flocking apparatus as claimed in claim 1, and further comprising conveyor means for conveying a workpiece between a setting position outside of said flocking chamber and a working position in said flocking chamber at which working position the workpiece is supported by said workpiece support means.

3. An electrostatic flocking apparatus as claimed in claim 1, wherein the power source means of at least one of said first and said second electrodes includes voltage varying means for varying the amplitude of the voltage of the electrode to which said power source means including the voltage varying means is electrically connected.

4. An electrostatic flocking apparatus as claimed in claim 1, wherein said workpiece support means comprises a truck for directly supporting a workpiece, and rails for slidably supporting and guiding said truck.

5. An electrostatic flocking apparatus as claimed in claim 2, wherein said flocking chamber comprises a sidewall having an aperture extending therethrough, and said workpiece support means is movable by said conveyor means through said aperture between the setting and the working positions.

6. An electrostatic flocking apparatus as claimed in claim 5, wherein said workpiece support means includes a truck, said conveyor means includes means for engaging said truck to move said truck through said aperture between the setting and the working positions, and further comprising an air blow mechanism disposed in said aperture for blowing fibers off of said truck as said truck is moved through said aperture.

7. An electrostatic flocking apparatus as claimed in claim 5, and further comprising a lifter disposed adjacent said aperture and including a workpiece holder disposed at two different levels, each said workpiece holder supporting a portion of said conveying means, and said lifter being vertically movable to move each said portion of the conveying means vertically.

* * * * *